US008857495B2

(12) United States Patent
Marocco

(10) Patent No.: US 8,857,495 B2
(45) Date of Patent: Oct. 14, 2014

(54) BLIND WITH HEAD RAIL AND CONTROL GUIDES

(76) Inventor: Mario M. Marocco, Toronto (CA)

( * ) Notice: Subject to any disclaimer, the term of this patent is extended or adjusted under 35 U.S.C. 154(b) by 21 days.

(21) Appl. No.: 13/374,952

(22) Filed: Jan. 25, 2012

(65) Prior Publication Data

US 2012/0291963 A1 Nov. 22, 2012

Related U.S. Application Data

(63) Continuation-in-part of application No. 13/067,189, filed on May 16, 2011.

(51) Int. Cl.

| | |
|---|---|
| ***E06B 9/56*** | (2006.01) |
| ***E06B 9/262*** | (2006.01) |
| ***E06B 9/40*** | (2006.01) |
| *E06B 9/24* | (2006.01) |

(52) U.S. Cl.

CPC . *E06B 9/262* (2013.01); *E06B 9/40* (2013.01); *E06B 2009/405* (2013.01); *E06B 2009/2452* (2013.01)

USPC ..... 160/120; 160/89

(58) Field of Classification Search

USPC ..... 160/120, 85, 86, 321, 323.1, 121.1, 89

See application file for complete search history.

(56) References Cited

U.S. PATENT DOCUMENTS

| | | | | | |
|---|---|---|---|---|---|
| 1,756,496 | A * | 4/1930 | Warnick | 160/269 |
| 2,280,358 | A * | 4/1942 | Tietig | 160/120 |
| 2,581,433 | A * | 1/1952 | North et al. | 160/120 |
| 4,039,019 | A * | 8/1977 | Hopper | 160/121.1 |
| 4,369,829 | A * | 1/1983 | Casiday | 160/120 |
| 4,453,584 | A * | 6/1984 | Steele | 160/121.1 |
| 4,679,406 | A * | 7/1987 | Weiblen | 62/262 |
| 4,724,885 | A * | 2/1988 | Chang | 160/89 |
| 5,092,389 | A * | 3/1992 | Tedeschi | 160/321 |
| 5,137,073 | A * | 8/1992 | Huang | 160/321 |
| 5,205,334 | A * | 4/1993 | Judkins | 160/89 |
| 5,664,613 | A * | 9/1997 | Jelic | 160/84.05 |
| 6,666,251 | B2 * | 12/2003 | Ikle | 160/120 |
| 6,712,115 | B2 * | 3/2004 | Judkins | 160/32 |
| 7,059,377 | B2 | 6/2006 | Nien et al. | |
| 8,261,808 | B2 * | 9/2012 | Perkowitz | 160/108 |

* cited by examiner

*Primary Examiner* — David Purol

(57) ABSTRACT

A blind for a building opening, and having a head rail attachable adjacent to the building opening; a blind panel stored in the head rail, and adapted to be lowered, over the building opening; and, blind panel control mechanism in the head rail and control guides leading the control so as to hang free of the blind panel, and permitting the blind panel to fill the building opening.

8 Claims, 10 Drawing Sheets

BLIND WITH HEAD RAIL AND CONTROL GUIDES

This application is a Continuation-in-Part of application Ser. No. 13/067,189 filed May 16, 2011, title Double Blind and Head Rail, Inventor Mario M Marocco. The invention relates to blinds for windows, having a head rail and at least a single and preferably a double blind system, retractable within or along the head rail, operated by control elements, and in which guides are provided for blind control elements, so that the controls hang clear of the edges of the blind system.

FIELD OF THE INVENTION

Background of the Invention

In the past, conventional blinds for windows have typically been either venetian style blinds with transverse strips, or so called vertical blinds, with vertical strips. These blind systems could have a mechanism whereby the strips could be operated, usually being rotated between closed and open positions.

Such blind systems could also be deployed and retracted completely, by the same mechanism. However in the open position, in which light is transmitted into the room, there was also a loss of privacy. In the closed position, most of the light was obscured. However, even when closed these blinds did not provide for a "dark" effect. Some light could always be seen through the edges of the closed strips.

Other blinds are known which simply consist of a panel of thick flexible material, wound onto a roller in a headrail. The material can be pulled down for privacy, and to obscure the light, providing for a dark effect, or raised to allow passage of light, but with loss of privacy.

Recent developments in blind design have found that consumers are interested in obtaining blinds with a greater variety of light and dark effects, but which none the less provide for privacy.

In some such blinds the blind consists of two panels of blind material, where a first panel and a second panel hang as separate panels, from a blind header incorporating two mechanisms, or rollers, for the two panels.

When this second panel is lowered, it provides for complete light exclusion, which may be desirable for sleeping. One such system is shown in U.S. Pat. No. 7,059,377, Double Layer Roller Blind issued Jun. 13, 2006.

The design of a blind header rail providing two mechanisms or rollers, for handling two such panels, and particularly, the provision of the second roller for the second panel, presents numerous problems. In the first place the head rail must be compact and aesthetically pleasing. Desirably the blind head rail shall occupy no more space, or only slightly more space at the top of the window opening than previously known blinds. In most blinds controls are provided for retracting and deploying the blind, or blinds. These controls are usually continuous elements such as cords or chains, of metal or plastic.

The cords hang down at one end of the head rail. They are usually located alongside the edge of the blind. Operation of the controls can sometimes interfere with the blind. In some cases it can actually damage the edge of the blind.

Where there are two separate blind panels hanging from the one headrail, the operation of the two separate blind panels by two sets of such controls presents even more chances of interference and damage.

Any such system must be simple and capable of being operated by either manual controls, or in the case of more complex designs by means of power controls, and even remotely operated power controls.

The blind controls or elements are usually chains or cords, hanging down from the headrail, and controlling the first and second mechanisms or rollers.

One of the problems experienced with such cords is that some space must be allowed for the cord loops to hang beside one edge of the blind panels.

This space along one vertical edge of the blind panels, then allows some light in, and the blind fails to obscure all light, when used in the "dark" mode.

Another problem is that when an operator manipulates the cords, the edges of the blind panels gradually become damaged. The appearance, and life, of the blind is therefor impaired.

BRIEF SUMMARY OF THE INVENTION

With a view to achieving the foregoing desirable features, the invention provides a blind for a building opening, and having a head rail, attachable above the building opening, a blind system supported in the head rail, operation mechanism for retracting and deploying the blind system, and control elements at at least one end of the head rail for operating the control mechanism, and control guides in the head rail guiding the controls to hang forwardly of the blind system.

The blind system may have two rollers for supporting two blind panels, and controls operating the rollers. In another embodiment one of the support mechanisms may be a track, with blind controls sliding transversely along the track. The control mechanism may be in the form of control rods, instead of cords, and may also me power operated. The blind system may consist of a blind panel having separate blind strips hanging down from the head rail and mechanism in the head rail for retracting the strips to one end of the head rail and for deploying the strips along the head rail.

In a preferred form there is a first blind panel stored in the head rail, and adapted to be lowered over the building opening, a second blind panel stored in the head rail and adapted to be lowered over the building opening, the first blind panel being formed of light permeable material, whereby to admit at least some light into the interior of the building, and the second panel being formed of light impermeable material, and control mechanism in the head rail with guides in the head rail to lead the control forwardly in front of the blind panels, so that the controls hang forwardly of the edges of the first and second blind panels, to avoid damaging the edges of the blind panels, and permitting the blind panels to fit the building opening to maximize privacy and light exclusion.

Preferably the invention provides such a blind in which the first blind panel hangs in a loop forming two sheets or parts of the first panel. Transverse blind strips, alternating between light permeable or translucent, and less permeable or dark, are formed in the first panel, at spaced intervals there across. Blind panel control mechanism in the head rail enables the first blind panel to be adjusted so that one part of the loop moves relative to the other. In this way the blind strips can be moved, alternating between lighter and darker positions. In this embodiment the second blind panel will typically be a dark effect, opaque, material, stored on a roller in the headrail, and operable to be lowered when darkness is desired.

Preferably the blind will further include a bottom rail attached to the loop of the first blind panel for holding, providing a mass weight to hold the loop of the first blind panel in position.

Preferably the blind will incorporate blind panel control mechanisms and controls such as cords for each of said first and second blind panels whereby the same can be controlled and adjusted and raised upwardly and stored in the head rail.

In particular, the head rail will incorporate a first blind roller mechanism, and first blind panel cord guide channels surrounding said first blind roller, and further including second blind roller mechanism and second blind panel cord guide channels, surrounding said second guide roller mechanism.

Preferably the first blind panel cord guide channels will terminate adjacent a lower edge of the blind head rail, and the second blind panel cord guide channels will terminate at a region intermediate the lower edge and upper edge of the head rail, and the second cord guide channel being displaced so as to lie alongside portions of the first cord guide channel.

Preferably there is a blind anchor in the head rail for anchoring an end of the loop of the first panel so that it may hang in a loop.

Preferably there is a guide wall in the head rail for guiding the second blind panel, and separating it from the first panel.

Preferably the head rail is formed of an elongated channel with a front wall, a top wall, and a back wall, and end cap members attached at each end of said channel, and blind roller supports incorporated in said end caps.

The first or loop panel is usually translucent and usually has transverse opaque strips, spaced apart from one another, which can provide greater or lesser degrees of light transmission or exclusion. By the operation of the first roller one loop of the first panel can be moved relative to the other loop. This also provides for some degree of privacy. The transverse strips, in the two sides of the loop, can then be aligned, thus leaving open the translucent strips between them and thus allow light to permeate the two loops of the first blind panel. Alternatively the opaque strips of one part of the loop can be made to register with the translucent strips in the other portion of the loop so that more light is excluded.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

Figure 10:
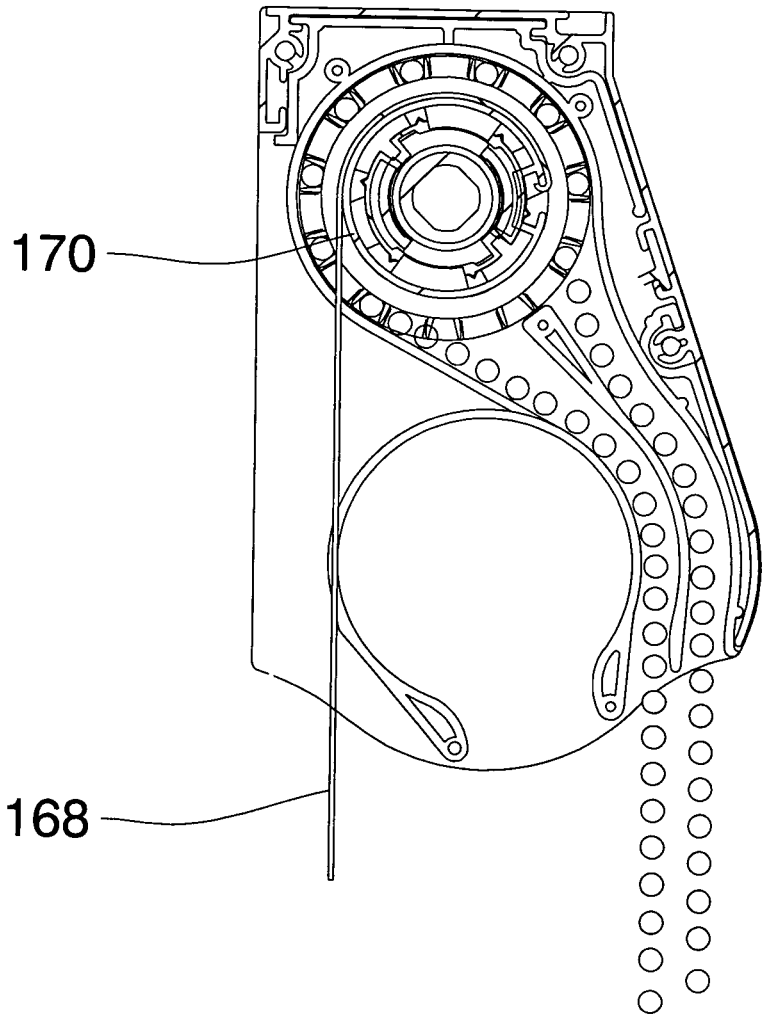
Figure 11:
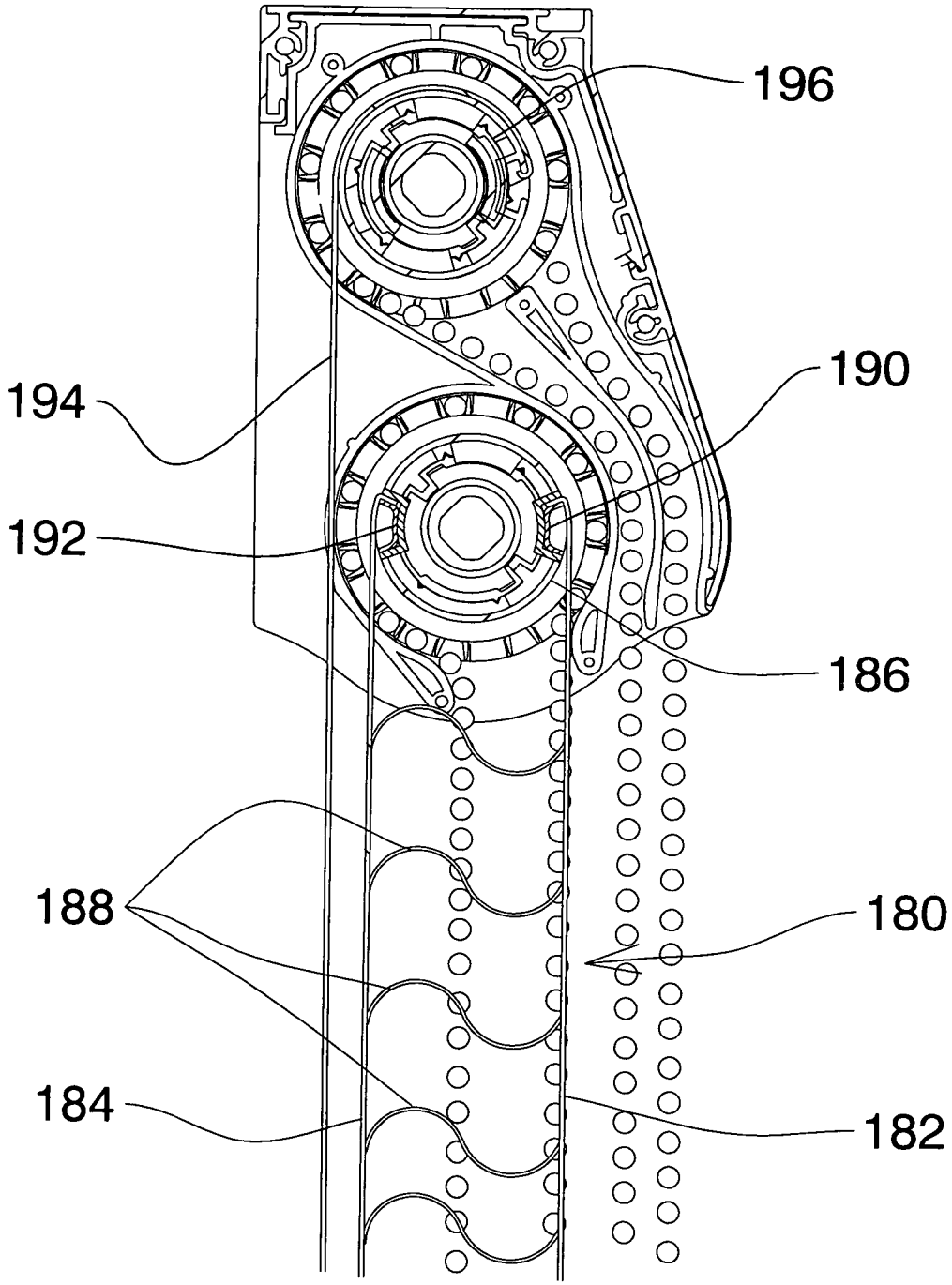

FIG. 10 is a side elevation of another embodiment, showing the head rail of the previous embodiment adapted for use with a single blind panel, with control elements hanging forwardly of the blind panel; and, FIG. 11 is a side elevation of another embodiment, showing a front blind panel formed of two sheets of translucent material, with transverse strips extending between the two sheets, and showing a second dark blind panel.

DESCRIPTION OF A SPECIFIC EMBODIMENT

It will be seen that the blind illustrated generally as (10), comprises a head rail (12) and a bottom rail (14). The blind is typically located over a building opening such as a window.

The blind, in this first embodiment, provides a first looped translucent blind panel (16) and a second opaque dark effect blind panel (18). It will be seen that the first and second blind panels are supported so as to hang vertically. The second panel (18) has the usual bottom rail, of a type well known in the art.

First panel (16) is a loop of material which passes around a bottom rail roller (20) in the bottom rail (14), so as to hold the looped panel in position.

The first and second blind panels are spaced apart from one another.

The first blind panel is formed of light permeable material, which is at least partly translucent, so that some reduced light can pass through and permit at least some light to pass into the interior of the building, even when the first panel is lowered.

In order to provide for a greater or lesser exclusion of light, first blind panel (16) is provided with transverse darker blind strips (22). Strips (22) are formed of thicker or different texture material such that the strips are at least less light permeable, than the rest of the fabric of the blind panel (16). The transverse strips (22) are located at spaced intervals, horizontally spaced apart down the loop of front panel (16). Between the strips (22), spaces (24) of the fabric of the first panel (16) are more light permeable, than the strips (22), and can thus providing alternating light and dark strips. As shown, the first panel hangs down in a loop. By adjusting the loop it is possible to either align the dark strips (22) in one portion of the loop, with the dark strips (22) in the other portion of the loop. This will provide passage of light through the lighter spaces (24). By adjusting the loop slightly, the dark strips (22) in one portion of the loop can be made to move and thus register with the light spaces (24), in the other portion of the loop. This will provide more privacy and less light.

By suitable mechanism (described below) the first and second blind panels can be adjusted, and raised or lowered, and can be retracted back up into the head rail (12) in order to provide a completely open area in the building opening or window.

In order to provide for these functions the head rail (12) carries an upper second panel roller (30), and a lower first panel roller (32), located below the upper roller (30). The two rollers are operable, in this embodiment by respective first and second control cords (34) and (36). The second panel is of substantially opaque dark effect material. When it is lowered, it will prevent transmission of light, and provide for darkness within the building. This may be desirable to persons wishing for complete darkness for sleep, or for conducting work requiring a dark environment.

Head rail (12) comprises an elongated transverse channel, preferably of extruded metal, and having screw receiving mouldings (40) formed therein.

Head rail (12) defines a front cover wall (42), a top wall (44) and a back wall (46). Suitable mounting devices (not shown), for securing the head rail and blind to a building, can be secured to the back wall or top wall, depending on the fabric of the building to which it is be attached.

At each end of head rail (12) there is an end cap (48), preferably formed of thermoplastic.

The end cap (48) comprises a main body (50) having a flat planar exterior.

Holes (52) in body (50) allow screws to be passed through and secured in screw mouldings (40) in head rail (12).

Main body (50) is formed with integral upper and lower hub bearings (54) and (56).

An upper stub sleeve (58) is rotatably mounted in upper hub bearing (54) A lower stub sleeve (60) is rotatably mounted in lower hub bearing (56).

An upper drive gear (62), mounted on hub (54) is connected to the upper stub sleeve (58), A lower drive gear (64) mounted on hub (56) is connected to the lower stub sleeve (60).

Cover plate (66) has openings which fit over the sleeves (58) and (60) and is secured to main body (50).

The drive gears receive respective upper and lower control elements (such as cords or chains hereinafter cords), (34) and (36). Such cords, as is well known, hang down in endless loops, and one or other of the loop portions can be grasped and drawn down, to operate the respective stub shafts.

The cords, in this case, are the typical metal chain cord, having metal spheres connected together by wire links, such as are well known in the art. The spheres are also commonly made of thermoplastic, in a variety of colours.

Cords or elements of other designs are known and could be used.

The main body (50) of the end cap (48) is formed with upper cord guide ribs (70) and an intermediate ribs (72), and lower ribs (74).

The ribs (70) and (72) and (74) define between them cord paths or channels for the upper cord. The ribs thus guide the upper cord loop downwardly and extend in an arc around and forward of the lower sleeve (60), and gear (64).

In this way the cord loop for the upper hub shaft will hang well forward of the edges of the first and second blind panels (16) and (18).

The lower roller cord loop extends around lower drive gear (64) and is enclosed by ribs (74) and (76) forming a cord guide path or channel, for the two loop portions of the lower cord.

Lower rib (76) is hollow and rounded and extends at (78) forward to, or beyond, the axis of lower hub (56). Lower rib (78) thus guides the lower cord loop so that it too hangs forward of the edges of the first and second blind panels.

While the guide ribs are formed integrally with the main body, in this example, they could be formed separately, and attached, or held in position, in various ways.

Upper blind roller (32) makes a friction fit on sleeves (58), at each end.

Lower blind roller (30) makes a friction fit on sleeves (60) at each end.

Each blind roller has a groove (80) in which edges of the respective blind panels are secured.

An intermediate loop fastening wall (82), which in this case is formed of extruded metal, for example, but could be formed in other ways, is secured in a groove (84) inside the front wall (42) of the head rail (12).

The fastening wall (82) is, in this case, removable, by sliding out of the groove. However, the wall could be permanently fastened to the head rail, or could be formed integrally with the head rail.

The fastening wall (82) extends between the upper and lower rollers (30) and (32), and terminates adjacent to but spaced from the back wall (46). A first blind panel loop fastening groove (86) is formed along the free edge of wall (82), and the free end of front looped blind panel (16) is secured in groove (86).

In order to guide and separate the rear opaque or dark panel (18) from the looped front panel (16), a separator wall (88) extends adjacent the back wall (46).

Second blind panel (18) passes between separator wall (88) and back wall (46). In operation the first or front panel (16) can be lowered, while the second panel (18) remains retracted.

As front panel (16) is lowered it will run around roller (20) in the bottom rail (14). If light is required then the front panel can be adjusted so the dark strips (22) are positioned horizontally spaced from each other. This will allow passage of light through the intervening spaces (24).

If less light is required, or for greater privacy, the front panel can be adjusted so that the dark strips (22) in one portion of the loop line up with the lighter intervening spaces (24), in the other portion of the loop.

For complete light exclusion the second blind panel (18) is lowered.

However the first panel may be allowed to remain hanging down and provide a pleasing aesthetic decorative effect.

The operation of the blind panels by the cords and the manipulation of the cords, can be managed forwardly of the two blind panels, and without contact their edges.

In addition by guiding the cord loops to hang forwardly, the blind panels can be measured and designed so that they fill the full width of the building opening or window, and thus provide maximum privacy, and exclusion of light.

Figures 5, 6:
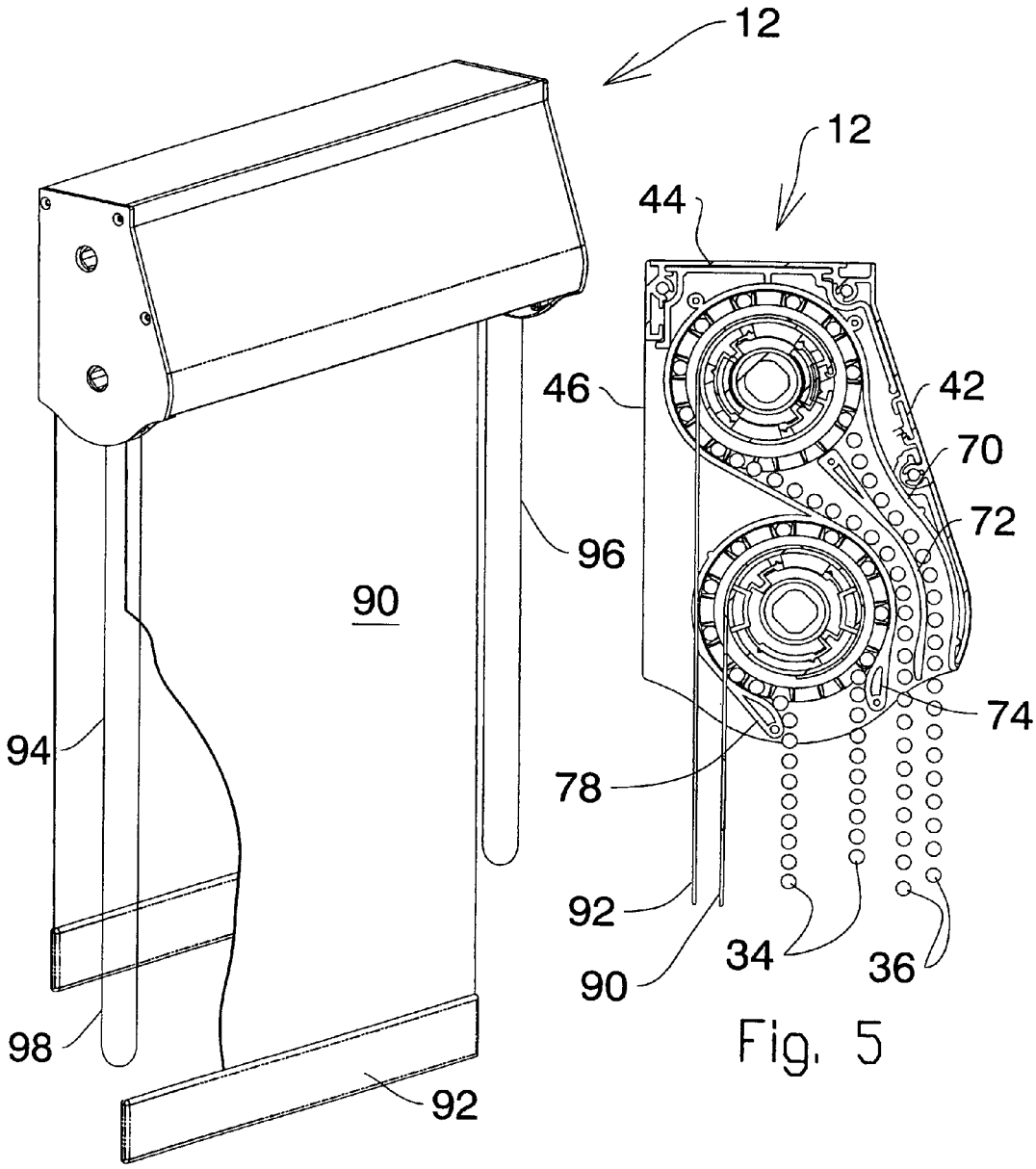
FIG. 5 is a section corresponding to FIG. 2 showing another embodiment.
FIG. 6 is a perspective of another embodiment.

A somewhat simplified embodiment is shown in FIG. 5.

In this case the front blind panel (90) is a single sheet. There is no loop.

The lower end is attached to a bottom rail (92).

Figure 1:
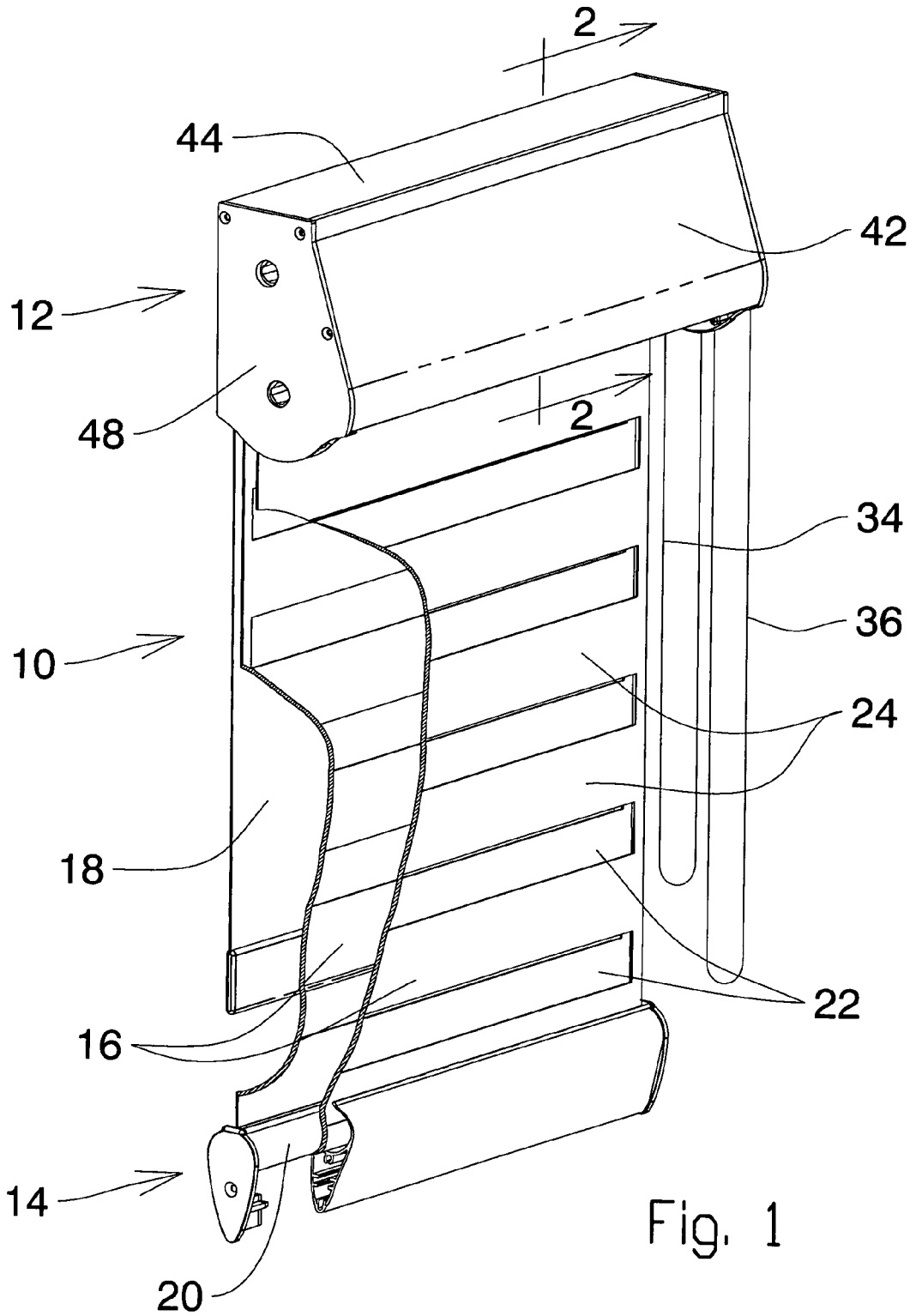
FIG. 1 is a general perspective of a typical blind illustrating the invention and showing a first looped blind panel, with alternating light and dark transverse blind strips, and a second opaque blind panel, and a head rail.
Figure 2:
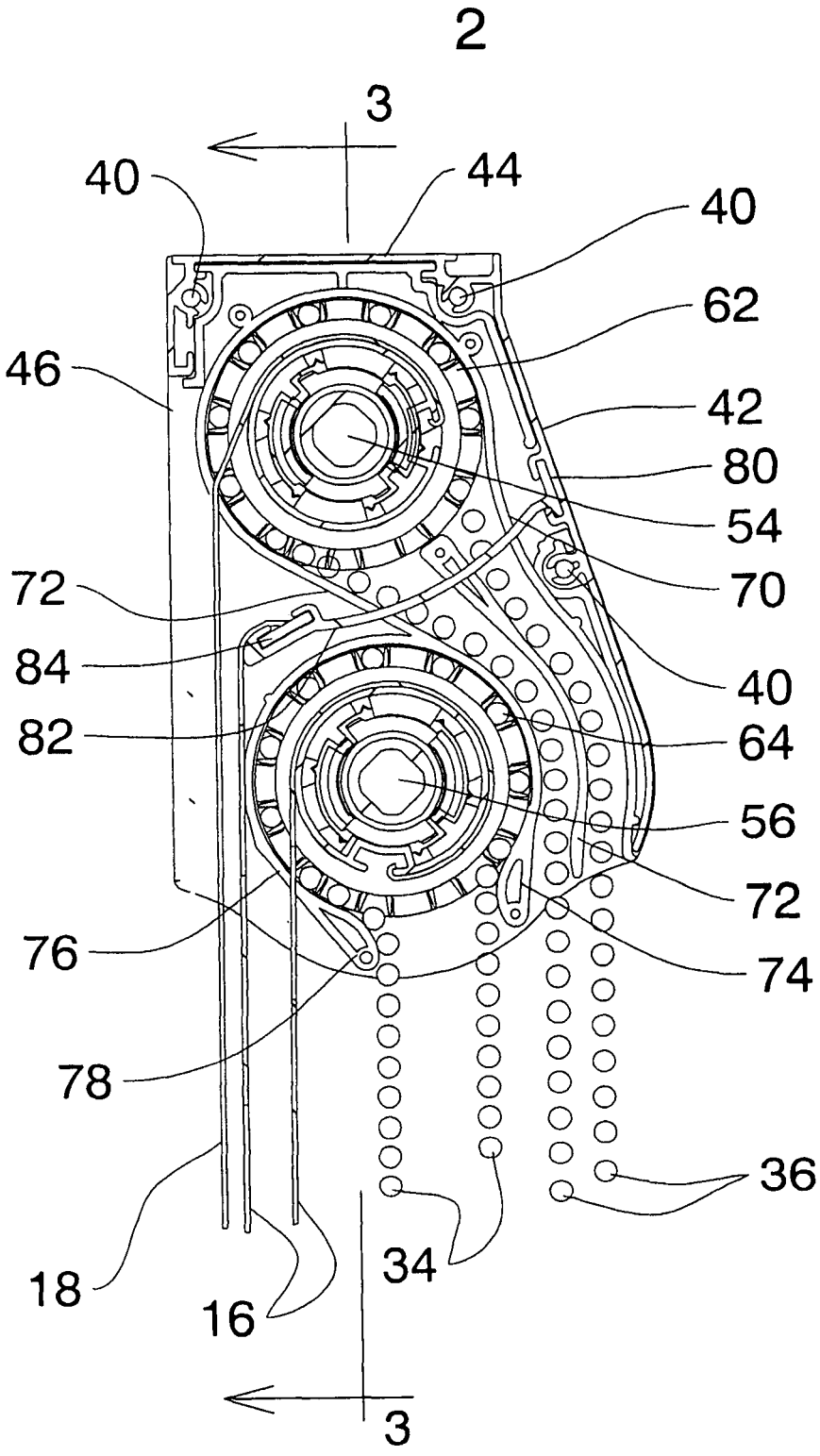
FIG. 2 is a section along line 2-2 of FIG. 1.
Figure 3:
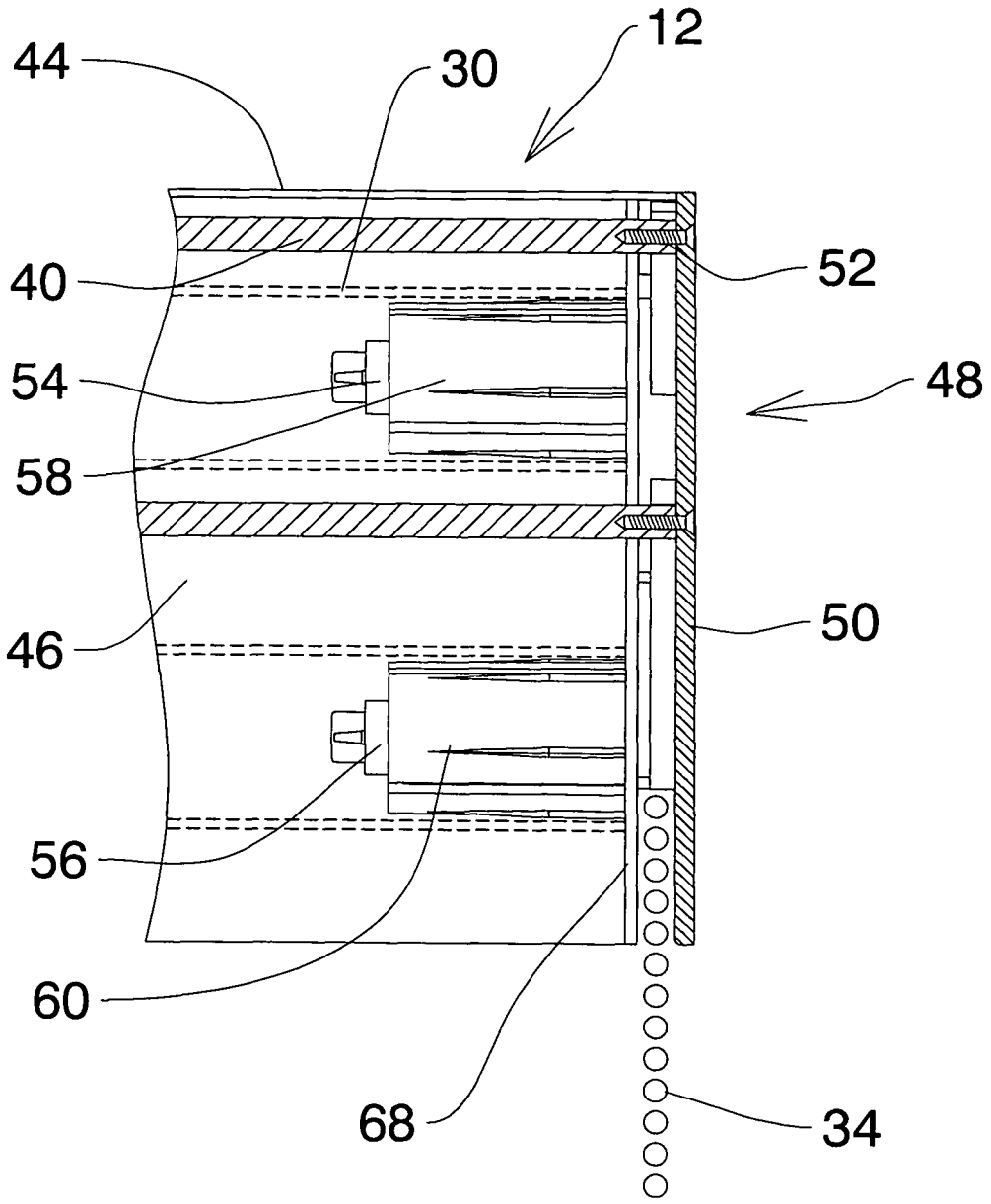
FIG. 3 is a section along line 3-3 of FIG. 1.
Figure 4:
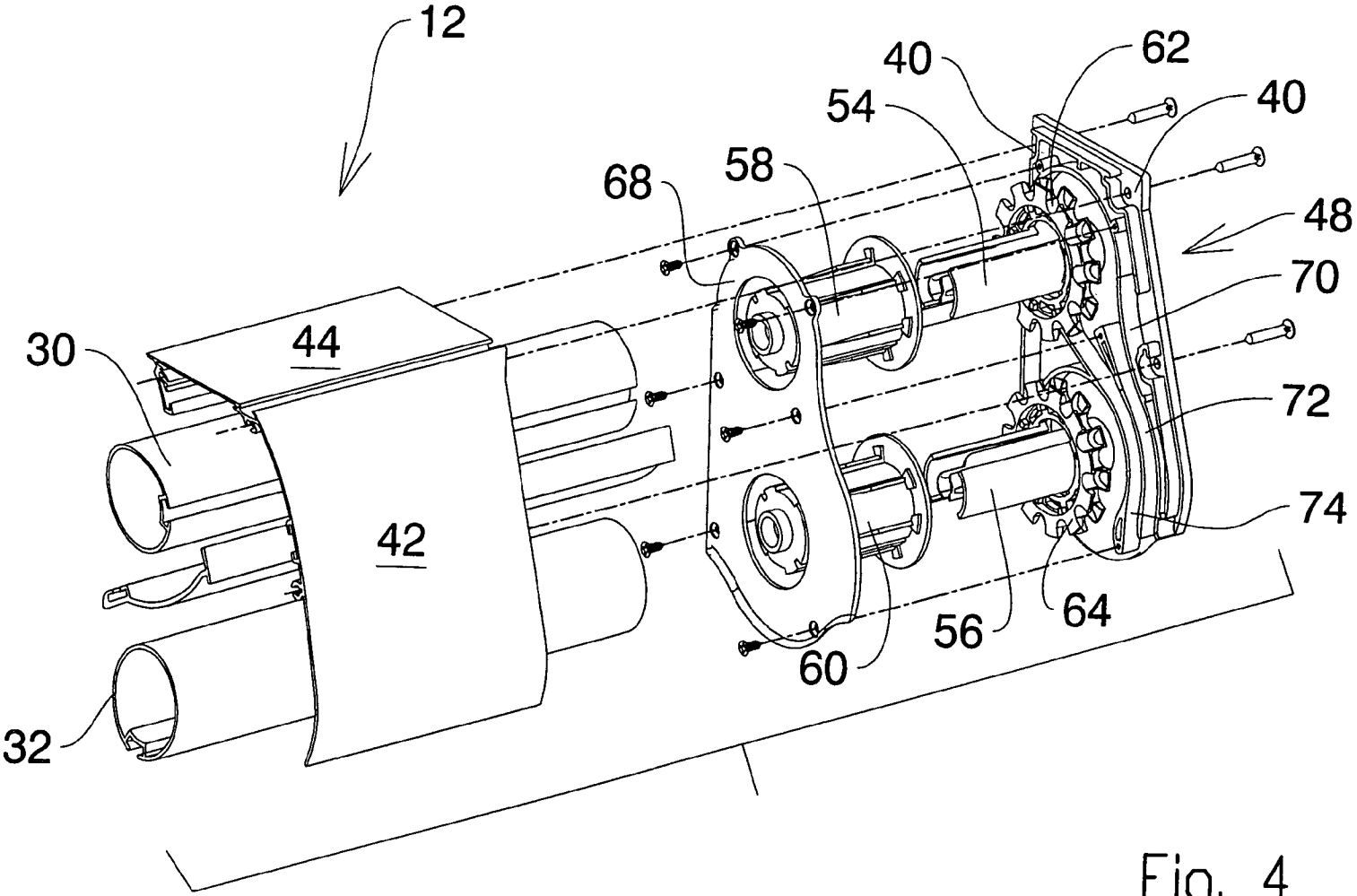
FIG. 4 is an exploded perspective of one end of the headrail.

The fastening wall extrusion (82) of FIG. 2 has been removed as it is not required. There is no dead end of the front panel (90) to be secured, in the head rail.

The second panel (94) is similar to the second panel of FIG. 2.

The control cords and guides are the same as in FIG. 2, and have the same reference numbers.

The cords are guided, as before, forwardly of the edges of the first and second panels Another possible variation is shown in FIG. 6.

In this case the front blind panel control cord (96) is shown located at one end of the head rail, and the control cord (98) for the second panel is located at the opposite end of the head rail.

In this case the end caps (100) are the same as in FIG. 2, and both sets of control cords are guided forwardly of the edges of the two blind panels.

It is possible that the same headrail can be used for a simpler blind with only a single blind panel. In such a case there would be only one cord loop (not shown), but it would still be guided by the appropriate ribs and hang forwardly of the blind panel, so as to avoid damage to the edge of the panel.

The use of the forward guiding of the control cords also has the result of permitting the blind panel, or panels, to be made to the full width of the window opening, and thus provide for more effective light exclusion, when required.

Figure 7:
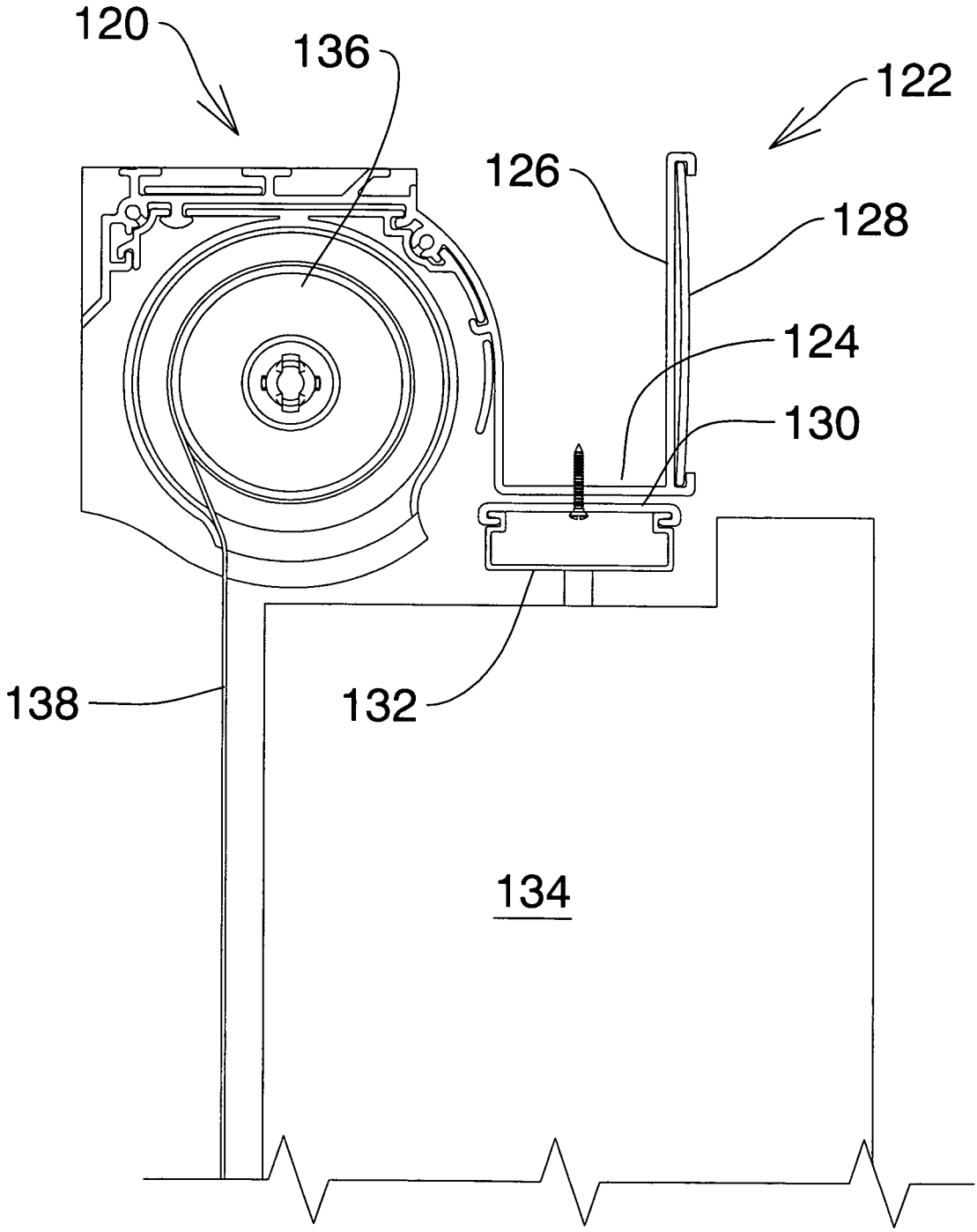
FIG. 7 is a side elevation of another embodiment; showing a vertical strip blind as the front panel, and a dark effect material as the second panel.

The head rail can be adapted for use with a variety of different types of blind designs. FIG. 7 shows the head rail (120), modified somewhat to support a typical vertical blind. Thus head rail (120) has a front wall extension (122) formed integrally.

Extension (122) is of generally L-shaped section, having a horizontal wall (124) and a vertical front wall (126).

Any suitable trim strip (128) can be supported in vertical wall (126) in known manner. A typical transverse blind track (130), of known design can be simply secured to the underside of wall (124). Trolleys (132) on track (130) carry vertical strips (134), in known manner Such vertical blinds can be operated by cords, or by wands, in known manner.

Within head rail (120) a single roller (136) carries a second blind panel (138). This is formed of opaque dark effect material.

Suitable cords are provided for operation of roller (136), being guided forwardly of the edge of panel (138) by guides such as shown in FIGS. 1 to 6.

Thus the vertical strips forming the first blind panel can be deployed to provide some privacy, and some light exclusion, as desired.

When darkness is required the second panel (138) can be lowered.

Figure 8:
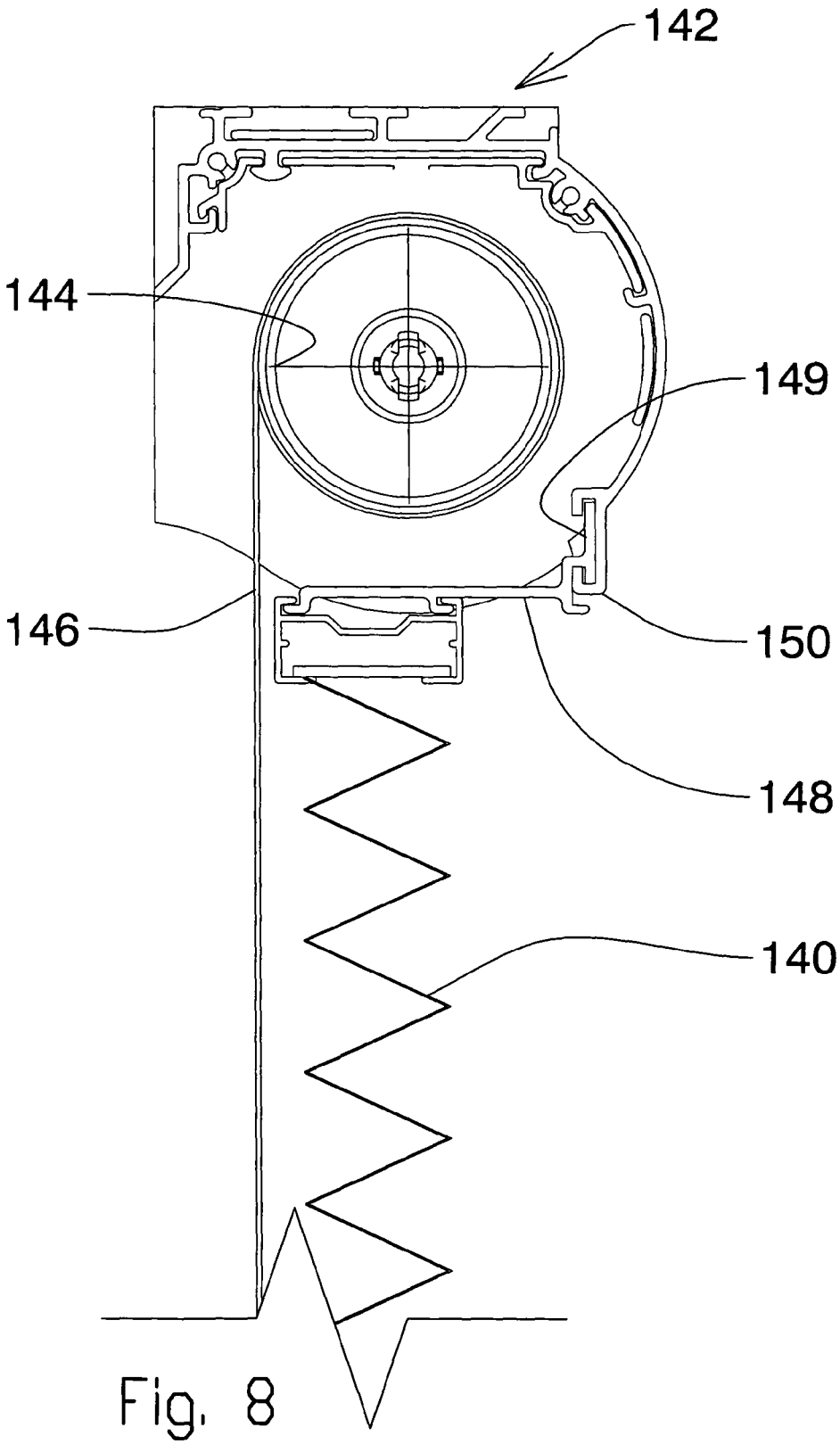
FIG. 8 is a side elevation of another embodiment showing a concertina material as the front panel and a dark effect material as the second panel.

FIG. 8 shows another embodiment. In this case the front or first panel is of concertina type blind material (140), typically made from semi translucent material.

In this case the head rail (142) has a single roller (144) for the second panel (146), similar to FIG. 7, being formed from opaque dark effect material. The front panel is supported by a horizontal support wall (148).

Wall (148) is releasably attachable to head rail (142), by a slide flange (149) fitting in a channel (150).

Suitable control cords are provided (not shown), similar to FIG. 7.

Figure 9:
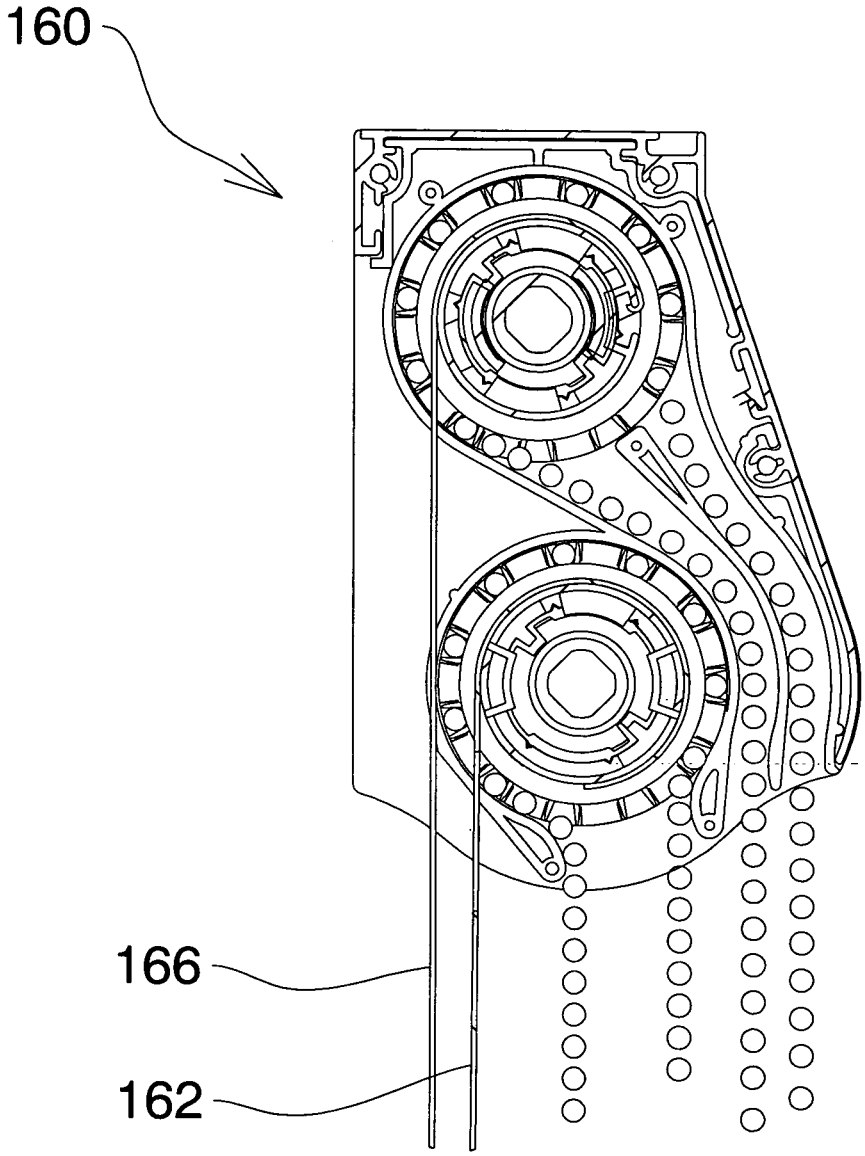
FIG. 9 is a side elevation of another embodiment, showing both first and second panels as being material wound onto rollers.

Another embodiment is shown in FIG. 9.

In this case the head rail (160) is similar to FIGS. 1 to 5, with guides for the control cords, as already described.

In this case the front panel (162) is a simple single panel of semi translucent material, which may, for example be of natural origin, such as bamboo, or other semi translucent fabrics such as are well known.

The second panel (166) is of dark effect opaque material, as before.

Suitable controls operate the respective first and second panels, as before.

FIG. 10 shows essentially the same embodiment as FIG. 9, but in this case only the one blind panel (168) is shown, on a single roller (170). The head rail is of the same design as FIG. 9, but the space for the front roller, of FIG. 9, is simply unused.

Another embodiment is shown in FIG. 11.

This appears to be similar to the FIG. 2 embodiment.

However in this case the front or first panel (180) consists of two separate sheets of semi translucent material (182) and (184). The two sheets hang from the same roller (186). The two sheets are in fact adapted to be wound up, or lowered from the one roller (186).

Between the two sheets there are a plurality of transverse strips (188) of generally S-shaped configuration. The strips (188) are bonded or joined in other ways, to respective sheets (182) and (184).

The roller control mechanism is of a type known per se, and permits the two sheets to be arranged to hang as shown in FIG. 11, so that they are separated from each other, with one sheet wound up on one side of the roller, and the other sheet wound up on the other side of the roller.

When in this configuration the transverse strips are displaced apart from each other as shown in FIG. 11.

This permits a greater amount of light to pass through the two sheets, into the interior of the building.

By manipulation of the roller, the two sheets (182) and (184) can be displaced relative to one another, so that they will hang from the same side of the roller. This will cause the strips (188) to become rearranged so that they lie in more or less a vertical arrangement. The edges of the strips will register or overlap. This will block passage of more light, giving greater privacy.

Channels (190) and (192) are formed in roller (186) and receive the edges of respective sheets (182) and (184).

The second panel (194) hangs from upper roller (196), and is formed from opaque dark effect material. In this way the front panel can be manipulated, to provide more or less light, and gives a decorative appearance.

Panel (194) can be lowered when light exclusion is required.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A blind for a building opening, and comprising;

a head rail attachable adjacent to the building opening;

a first blind roller in said head rail;

a first blind panel attached to said first blind roller in the head rail, and adapted to be lowered over the building opening, and to hang downwardly in a substantially vertical first panel plane, said blind panel defining panel edges along each side thereof;

said first blind panel in turn comprising a face sheet, and an intermediate sheet;

said face sheet being attached along a first side of said first blind roller;

said intermediate sheet being attached to said first blind roller along a second side of said first blind roller, diametrically opposite to the attachment of said face sheet on said first side of said roller, whereby said face and intermediate sheets hang from opposite sides of said first blind roller, in spaced apart relation;

transverse strips connected between said face and intermediate sheets and extending in horizontal spaced apart relation;

first blind panel control mechanism in the head rail adjacent one end thereof whereby said first blind roller can be partially rotated for moving said face sheet relative to said intermediate sheet and thereby partially rotating said transverse strips;

first blind control cord elements connecting with said first blind control mechanism, and hanging down therefrom in a substantially vertical element plane;

first blind cord element guides in the head rail leading the first blind control cord elements forwardly;

a second blind roller in said head rail, and a second blind panel attached thereto;

a second roller drive mechanism, and a second roller control element for operation of said second roller drive mechanism; and, second blind control element guide ribs for guiding said second blind panel control element, and locating said second blind panel control element forward of the edges of said first and second blind panels; wherein said second blind panel is formed of a light obscuring material, to provide substantial exclusion of light.

2. A blind for a building opening as claimed in claim 1 wherein said headrail defines a front wall a top wall and a back wall, and including end caps for each end of said head rail.

3. A blind for a building opening as claimed in claim 2 including upper and lower hubs supported by said end caps, and upper and lower sleeves on respective said hubs.

4. A blind for a building opening as claimed in claim 3 including cover plates attached to respective end caps, and fitting over said sleeves.

5. A blind for a building opening as claimed in claim 4 including upper and lower drive gears on said respective said hubs, connecting with said sleeves, and said control cords engaging respective said drive gears.

6. A blind for a building opening as claimed in claim 5 wherein respective said sleeves support respective said blind rollers.

7. A blind for a building opening as claimed in claim 1 wherein said guide ribs for said second panel control element define an arc extending around and forwardly of said first blind panel, and wherein said guide ribs for said first panel control element include a lower portion extending forwardly of said first blind panel, and including an intermediate guide rib separating said second control element from said first control element.

8. A blind for a building opening as claimed in claim 7 including end caps on each end of said head rail and wherein said guide ribs are moulded integrally with said end caps.

* * * * *